United States Patent [19]

Teetz et al.

[11] 4,301,756

[45] Nov. 24, 1981

[54] DEVICE FOR THE INTERRUPTION OF THE EMBROIDERY NEEDLE MOVEMENT ON EMBROIDERY- OR SEWING MACHINES

[75] Inventors: Wolfgang Teetz, Kerken; Alfred Desprez, Wachtendonk, both of Fed. Rep. of Germany

[73] Assignee: Maschinenfabrik Carl Zangs Aktiengesellschaft, Krefeld, Fed. Rep. of Germany

[21] Appl. No.: 117,595

[22] Filed: Feb. 1, 1980

Related U.S. Application Data

[62] Division of Ser. No. 958,401, Nov. 7, 1978, abandoned.

[30] Foreign Application Priority Data

Nov. 7, 1977 [DE] Fed. Rep. of Germany ..... 2749700

[51] Int. Cl.[3] ..... D05B 55/16

[52] U.S. Cl. ..... 112/221

[58] Field of Search ..... 112/221, 220, 79 R, 112/84, 98

[56] References Cited

U.S. PATENT DOCUMENTS 3,884,165 5/1975 Tajima ..... 112/221 X 4,054,098 10/1977 Hoever et al. ..... 112/221 X

*Primary Examiner*—H. Hampton Hunter

*Attorney, Agent, or Firm*—Martin A. Farber

[57] ABSTRACT

An embroidery machine having a plurality of needle bars mounted parallel to each other for the working of different types and colors of threads, with automatic change of the needle bars driven at the time by a drive shaft. A plurality of needle bars are movably mounted adjacent each other in a common needle bar block which is displaceable transversely to the embroidery movement. A driver is fastened on each needle bar. A drive carriage is movably guided on a guide bar arranged parallel to the needle bars. A drive carriage which is driven from the drive shaft by means of a connecting rod and a crank can be coupled by means of a switch pawl with a contact piece which is also movably guided on the guide bar. The driver of each needle bar is provided with a roller which can be selectively inserted into a fork-shaped recess in the contact piece. On each side of the upper dead-center position of the contact piece there is a separate fixed guide cam for the rollers of the needle bars which are located outside the embroidery position.

5 Claims, 6 Drawing Figures

Figure 1:
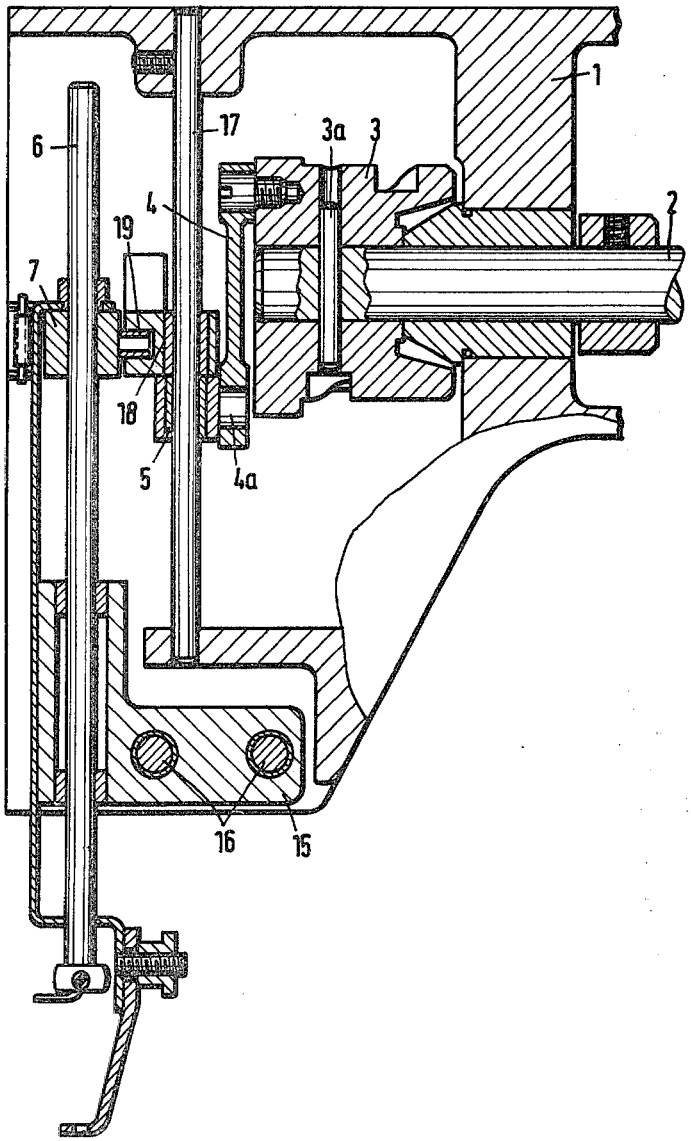

DEVICE FOR THE INTERRUPTION OF THE EMBROIDERY NEEDLE MOVEMENT ON EMBROIDERY- OR SEWING MACHINES

This is a division, of application Ser. No. 958,401 filed Nov. 7, 1978, and now abandoned.

The invention relates to an embroidery machine having a plurality of needle bars mounted parallel to each other for the working of different types and colors of threads, with an automatic change of the needle bars driven by means of a crank rod and a crank from a drive shaft.

An embroidery machine of this type is known with several needle bars being mounted movably adjacent each other in a common needle-bar block which is displaceable transversely to the embroidery movement and being adapted to be coupled selectively, by means from time to time of a driver fastened to each needle bar, to a drive carriage which is movably guided clamped on a guide bar arranged parallel to the needle bars and which is connected with the main drive shaft.

It is an object of the invention to provide and improved disconnection of the needle bars which are not participating in the embroidery movement.

Also with automatically controlled embroidery- or sewing machines, so-called jump stitches are necessary when the embriodery frame which carries the material to be embroidered is automatically shifted from one motif or pattern to the other. These jump stitches which connect the space between the last stitch of the finished motif with the first stitch of the new pattern must be separated apart by hand after the completion of the embroidery. In this manner there results not only the necessity of an after-treatment of the material which is automatically embroidered on the machine manually, but altogether a considerable additional working expense.

In order to avoid separating out the jump stitches after completion of the embroidery, it is already known to provide automatic embroidery machines with a device by which the stitch formation can be intermittent or skipped from time to time. With this known device by means of a magnet the needle rod or shank turns in the block by about 90°, the latter causing its back and forth movement, so that as a consequence of the simultaneous rotation of the needle which is fastened on the needle bar or rod, the shuttle or gripper cannot receive or hold the loops of the threads, whereby the formation of stitches is prevented.

The known device indeed interrupts the formation of jump stitches, however does not avoid the penetration of the needle in the embroidery background. With different materials to be embroidered consequently undersired needle stitches remain visible, which are particularly disturbing when the embroidery background material is made of leather, synthetic leather or fine textile fabrics.

It is another object of the invention to create a device in accordance with the introductory mentioned type which also permits disconnection of even the needle actually participating in the embroidery process, intermittently or temporarily interrupting the embroidery needle movement on automatically controlled embroidery or sewing machines, particularly a multiple needle formation of an embroidery head for automatic embroidery machines, by which not only can the stitch formation be intermittently or temporarily interrupted, but rather a controlled interruption of the embroidery needle movement is possible with simple means without problem, without large changes in the construction of the embroidery head being necessary.

With the invention the drive carriage is moveably guided on a guide rod, the latter being arranged parallel to the needle bar, and the switch pawl is mounted on a contact member, the latter likewise being guided on the guide rod and being connected with the driver of the needle bar. This is particularly suited for embroidery automation machines with a color change device. With such a type of embroidery machines according to the invention several needle rods are mounted moveably parallel to one another in a common needle bar block, the latter being displaceable transversely to the embroidery movement, whereby the driver of that needle bar which is located respectively at the time in the embroidery position is connected with the contact members.

The driver of each needle bar is provided with a roller which is insertable in a fork-shaped recess of the contact member and at both sides of the contact member which is located in the upper deadpoint position, there is arranged respectively each one stationary guide curve track for the rollers of the needle bars which are located outside of the embroidery position. In this manner with simple means without problems there exists a possibility for interruption of the embroidery needle movement on multiple needle embroidery machines with a color change device, the disconnected needle bars of which are reliably secured. According to a further feature of the invention each disconnected needle is held at a sufficient spacing from the material to be embroidered, in the manner that the spacing of each guide curve increases from the table of the embroidery- or sewing machine with increasing distance from the contact member.

With a preferred formation of the device in accordance with the invention the pawl is formed as a double-arm lever of which one arm cooperates with a catch which is formed on the drive carriage and the other arm cooperates with the holding pawl. According to the invention the holding pawl is controlled by means of a switching or driving magnet.

In order to increase the reliability of the switching operation, in accordance with the invention the holding pawl is biased by a leg spring. So that a reliable interruption of the embroidery needle movement takes place even with high rotational speeds of the machine, the driver and the contact piece, respectively, is biased by a tension spring, the latter pulling these parts into the upper deadpoint position.

The device in accordance with the invention provides the advantage that with simply constructive means, the embroidery needle movement can be controlled and interrupted, whereby according to a further feature of the invention the switching magnet is controlled by the program of the automatic control of the embroidery- or sewing machine.

Figure 2:
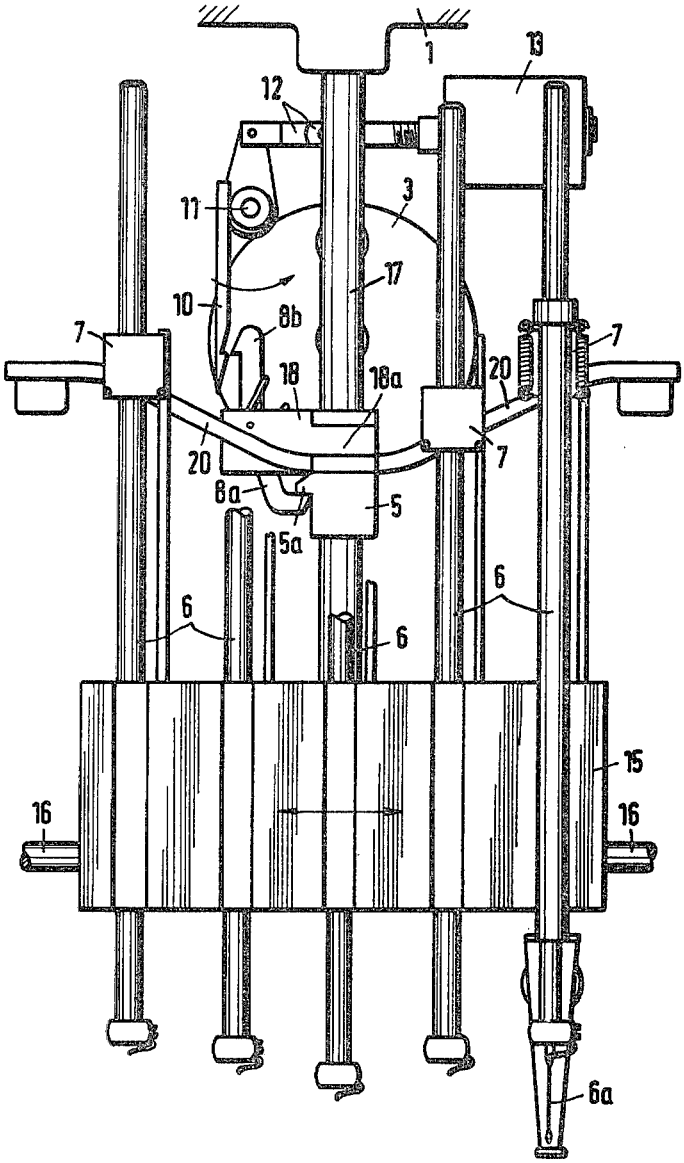
Figure 3:
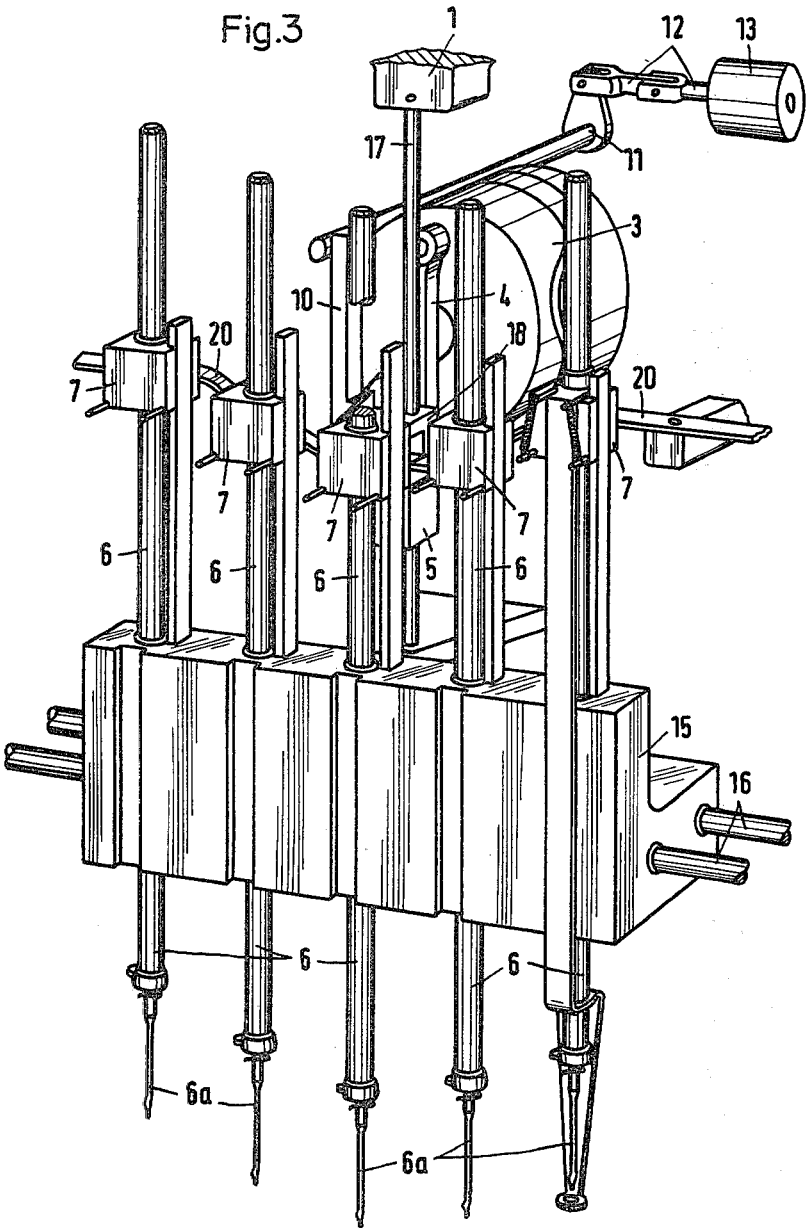

With the above and other objects and advantages in view, the present invention will become more clearly understood in connection with the detailed description of a preferred embodiment, when considered with the accompanying drawings, of which:

FIG. 1 is a longitudinal section through a head of an embroidery machine with a color change device, FIG. 2 is a front view of FIG. 1 and FIG. 3 is a perspective illustration of the embroidery head according to FIGS. 1 and 2.

A double-armed switch pawl 8 is pivotally mounted on a contact piece 18.

This switch pawl 8 is biased by means of a leg spring 9. The contact piece 18 and a drive carriage are displaceably mounted on a vertical guide rod 17 which is mounted in a housing 1. While the lower arm 8*a* of the pawl 8 cooperates with a catch 5*a* of the drive carriage 5, so that the contact piece 18 can be connected with the drive carriage 5 according to FIG. 2, the upper arm 8*b* of the pawl 8 cooperates with a holding pawl 10. This holding pawl 10 is pivotably mounted on a bolt 11, the latter being arragned stationary in the housing. The holding pawl 10 is actuated via a connecting rod mechanism 12 by a switching or drive magnet 13.

By means of a crank 3 and a crank or connecting rod 4 the drive carriage 5 is moved back and forth on the guide rod 17 with a turning main drive shaft 2. In the normal case, as it is illustrated in FIG. 2, the contact piece 18 is connected with the drive carriage 5 by means of the lower arm 8*a* of the pawl 8 and the catch 5*a*. A central needle bar 6 and consequently the needle which is fastened thereto is correspondingly moved via a driver 7 secured to the needle bar 6 and a roller 19 which engages the contact piece 18 as shown in FIG. 1.

If the embroidery needle movement is temporarily interrupted, for example during a displacement of the embroidery frame from one motif to the other, the switching magnet 13 is actuated, which magnet pivots the holding pawl 10 via the rod mechanism 12 in the direction of the arrow which is drawn in FIG. 2. As a consequence of this swinging movement the holding pawl 10 presses the upper arm 8*b* of the pawl 8 (clockwise in the drawing) back against the force of the leg spring 9 as soon as the contact piece 18 again arrives in its upper deadpoint position. By this pressing back, the lower arm 8*a* of the pawl 8 is uncoupled from the catch 5*a* of the drive carriage 5. The drive carriage 5 can now slide back and forth on the guide rod 17. By means of the holding pawl 10, to the contrary, the contact piece 18 is held secured or locked with the corresponding needle bar 6 in the upper deadpoint position.

By means of an actuation of the switching magnet 13 in this way it is possible, for example in dependency on the automatic control of the embriodery machine, to disconnect or stop the embroidery needle movement. This disconnection or switching-off can be entered in the program control of the embroidery or sewing machine in a simple manner. A renewed actuation of the switching magnet in this disengagably locked position last mentioned results in a renewed coupling of the drive carriage 5 to the contact piece 18 via the inclined surfances of the catch 5*a* and the lower catch arm 8*a* of the pawl via the snap action of the spring 9 as soon as the drive carriage 5 occupies its upper position according to FIG. 2. With high rotational speeds, preferably above 500 rotations per minute, in order to eliminate undesired movements of the needle bar 6 and of the driver 7, and to guarantee that the contact piece 18 is always located in the upper deadpoint position, the contact piece 18 is biased by means of a tension spring.

The embodiment according to FIGS. 1 to 3 schematically shows the head of an embroidery machine with a color change device. With the illustrated embodiment five needle rods (bars) 6 are moveably mounted in a needle rod block 15, which together with the needle bars 6 is displaceable on two bearing rods 16 in the direction of the arrow drawn in FIG. 2. Each needle bar 6 is thus mounted exclusively in the needle bar block 15, which block is displaceable at a right angle relative to the embroidery needle movement.

The needles 6*a* of the five needle bars 6 are each respectively provided with one yarn, which yarn either with respect to the color or other characteristics such as structure or thickness are differentiated from the other yarns. Only respectively from time to time one needle bar 6 can be located in the embroidery position which is drawn in FIG. 1. The other four needle bars 6 are respectively each disconnected.

In the embroidery position illustrated in FIG. 1, which is occupied in FIGS. 2 and 3 by the respective prevailing center needle bar 6, this needle bar 6 is connectable via the crank rod 4 and the crank 3 with the main drive shaft 2. With the embodiment form which is illustrated in FIGS. 1 to 3, this connection also is brought about via the drive slide carriage 5 which is moveably guided on a guide rod 17, the latter being arranged parallel to the needle rods 6 in the housing 1. A contact piece 18 moreover is located on this guide rod 17, which contact piece carries the pawl 8. The lower arm 8*a* of the pawl 8 cooperates with the catch 5*a* of the drive carriage 5, as this particularly is to be recognized in FIG. 2.

On its front side the contact member 18 is provided with a fork-like recess 18*a* which cooperates with a roller 19, which roller is arranged on the rearward side of each driver 7. The cooperation of this roller 19 with the fork-shaped recess 18*a* of the contact member 18 and the position of the roller 19 on the drive 7 of each needle bar 6 are best recognized in FIG. 2.

The actuation of the switch pawl 8 against the force of the leg spring 9 takes place as via the upper arm 8*b*, which upper arm cooperates with the holding pawl 10, and indeed by means of the switching magnet 13 (which can be recognized in FIG. 2) via the rod mechanism 12. The needle bar 6 which is located in the embroidery position consequently is connected positively without friction or slipping with the driver carriage 5 by means of the lower arm 8*a* of the pawl 8. Since the switch pawl 8 is not directly mounted on the driver 7 of the needle bar 6, which needle bar is found in the embroidery position, but rather on the contact piece 18, the latter which is guided moveably on the guide rod 17, there results an indirect connection via the fork-shaped recess 18*a* of the contact piece 18 in which there engages the roller 19, which roller 19 is aranged on the driver 7.

By a displacement of a needle bar block 15 transversely relative to the embroidery movement of the needle bars 6, which takes place by means of a transmission or mechanical gearing (not illustrated), that needle bar 6 which is to be driven by the main drive shaft 2 can be selected. With such a type of displacement movement of the needle bar block 15, the roller 19 of the needle shank 6, which needle bar is found originally in the embroidery position, steps laterally out from the fork-shaped recess 18*a* of the contact member 18. The roller 19 arrives on one of two stationary guide tracks or curves 20, the latter being arranged at both sides of the fork-shaped recess 18*a* of the contact member 18. These guide cams 20 are formed such that their spacing from the table of the embroidery or sewing machine increases with increasing distance from the contact piece 18. In this manner the needle bar 6 which are not found in the embroidery position are lifted further from the table than this corresponds to the upper deadpoint position. The needles 6*a* and the needle bars 6, respectively, which are disposed out of engagement thus constitute no obstacle during the operation of the embroidery machine.

The guide cams 20 guanantee that the rollers 19 which are arranged on the drivers 7 are reliably inserted in the fork-shaped recess 18 of the contact piece 18, so that each of the five needle bars 6 when needed can be connected with the drive carriage 5. For example with the embodiment of shifting movements of the embroidery frame during the exchange of one finished pattern or motif to a new motif, the needle bar 6 which is found respectively at the time in the embroidery position can be uncoupled from the drive carriage 5, For this purpose the switching magnet 13 is actuated, which via the rod mechanism 12 pivots the holding pawl 10 in the direction of the arrow drawn in FIG. 2, the holding pawl being pivotable about the bolt 11. The holding pawl 10 cooperates after this pivoting with the upper arm **8*b* of the pawl 8 and secures this pawl 8 together with the contact piece 8 in the upper deadpoint position while the drive carriage 5 which is connected with the connecting rod 4 is moved back and forth on the guide rod, 17 since the catch 5*a* of the drive carriage 5 has been released from the lower arm 8*a* of the pawl 8 upon the pivoting movement of the pawl 8**. The action for the intermittent or temporary interruption of the embroidery needle movement from time to time thereby occurs as explained .

We claim:

1. An embroidery machine, comprising a main drive shaft, a plurality of needle bars adapted for the working of different types and colors of threads respectively with an automatic change of the needle bars which are operatively driven respectively from time to time by said main drive shaft, a guide rod arranged parallel to said needle bars, a drive carriage is movably guided on said guide rod, means for connecting said drive carriage to said main drive shaft, comprising a crank and pivotally connecting rod connected to each other and to said drive shaft and said drive carriage, respectively, a contact member movably guided on said guide rod, switch pawl means for coupling said drive carriage to said contact member, a common needle bar block, means for mounting the latter displaceably transversely to an embroidery movement, said needle bars are mounted moveably adjacent and parallel to one another in said common needle bar block, a driver secured to each needle bar, respectively, said needle bars being adapted to be operatively coupable selectively to said drive carriage via said drivers in an embroidery position, a roller mounted on said driver of each of said needle bars, respectively, said contact member is formed with fork-shaped recess, said roller is insertable in said fork-shaped recess of said contact member, respectively, a stationary guide curve disposed at both sides of an upper dead-point position of said contact member, respectively, said rollers of the needle bars which are disposed outside of the embroidery position engage said guide curve, the distance of each said guide curve increases from a table of the embroidery machine with increasing distance from said contact member.

2. The embroidery machine as set forth in claim 1 wherein holding pawl means for releasably holding said switch pawl means out of contact from said catch, said switch pawl means is formed as a double-arm lever mounted on said contact member and having one arm which cooperates with said catch on said drive carriage and the other arm of said lever operatively engages said holding pawl means, respectively, switching means for controlling said holding pawl means.

3. The embroidery machine as set forth in claim 1 wherein said switch pawl means further for selectively mounting said contact member in the upper dead-point position simultaneously uncoupling said drive carriage from said contact member.

4. The embroidery machine as set forth in claim 1, further comprising spring means for biasing said contact piece pulling said contact member into the upper dead-point position.

5. An embroidery machine, comprising a main drive shaft, a plurality of needle bars adapted for the working of different types and colors of threads respectively with an automatic change of the needle bars which are operatively driven respectively from time to time by said main drive shaft, a guide rod arranged parallel to said needle bars, a drive carriage is movably guided displaceable relative to and on said guide rod, means for connecting said drive carriage to said main drive shaft, comprising a crank and pivotally connecting rod connected to each other and to said drive shaft and said drive carriage, respectively, a contact member movably guided displaceable relative to and on said guide rod, switch pawl means for coupling said drive carriage to said contact member, a common needle bar block, means for mounting the latter displaceably transversely to an embroidery movement, said needle bars are mounted movably adjacent and parallel to one another in said common needle bar block, a driver secured to each needle bar, respectively, said needle bars being adapted to be operatively coupable selectively to said drive carriage via said drivers in an embroidery position, a guide and engagement means mounted on said driver of each of said neelde bars, respectively, said contact member is formed with a fork-shaped recess, said guide engagement means is insertable in said fork-shaped recess of said contact member, respectively, a stationary guide curved disposed at both sides of an upper dead-point position of said contact member, respectively, said guide and engagement means of the needle bars which are disposed outside of the embroidery position engage said guide curve.

* * * * *

UNITED STATES PATENT AND TRADEMARK OFFICE

CERTIFICATE OF CORRECTION

PATENT NO. : 4,301,756

DATED : November 24, 1981

INVENTOR(S) : Wofgang Teetz, et al

It is certified that error appears in the above-identified patent and that said Letters Patent are hereby corrected as shown below:

Title page:

Item [54] the title should read --A MULTI-NEEDLE EMBROIDERY HEAD FOR DISCONNECTION AND INTERRUPTION OF THE EMBROIDERY NEEDLE MOVEMENT--

Item [62] "abandoned." should read --US Patent No.: 4,254,721 issued: March 10, 1981.--

Specification page:

Column 1, the title should read --A MULTI-NEEDLE EMBROIDERY HEAD FOR DISCONNECTION AND INTERRUPTION OF THE EMBROIDERY NEEDLE MOVEMENT--

Column 1, Line 6, "abandoned." should read --US Patent No.: 4,254,721 issued: March 10, 1981.--

Column 1, Line 23, "and" should read --an--

Column 4, Line 64, "bar" should read --bars--

Column 5, Line 23, "rod, 17" should read --rod 17,--

Column 6, Line 16, Claim 3 "claim 1" should read --claims 1 or 5--

Signed and Sealed this

*Eighth* Day of *June 1982*

[SEAL]

*Attest:*

GERALD J. MOSSINGHOFF

*Attesting Officer*

*Commissioner of Patents and Trademarks*